US008411003B2

(12) United States Patent
Tsai et al.

(10) Patent No.: US 8,411,003 B2
(45) Date of Patent: Apr. 2, 2013

(54) LIQUID CRYSTAL DISPLAY AND METHODS OF DRIVING SAME

(75) Inventors: Yu-Cheng Tsai, Hsinchu (TW); Kuo-Hsien Lee, Hsinchu (TW); Chao-Liang Lu, Hsinchu (TW); Jing-Tin Kuo, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 624 days.

(21) Appl. No.: 12/703,896

(22) Filed: Feb. 11, 2010

(65) Prior Publication Data

US 2011/0193842 A1 Aug. 11, 2011

(51) Int. Cl.
*G09G 3/36* (2006.01)

(52) U.S. Cl. ..... 345/87; 345/90; 345/92; 345/95; 345/100; 345/204

(58) Field of Classification Search ..... 345/87–100, 345/204–209, 690; 349/56, 84, 139, 143–144
See application file for complete search history.

(56) References Cited

U.S. PATENT DOCUMENTS

| | | | | |
|---|---|---|---|---|
| 7,633,472 | B2 | 12/2009 | Edwards | |
| 2001/0045925 | A1 | 11/2001 | Libsch et al. | |
| 2003/0189559 | A1 | 10/2003 | Lee et al. | |
| 2007/0211007 | A1* | 9/2007 | Su et al. | 345/92 |
| 2008/0024689 | A1* | 1/2008 | Ahn | 349/43 |
| 2008/0048957 | A1 | 2/2008 | Chiang et al. | |
| 2008/0158455 | A1* | 7/2008 | Yoo et al. | 349/38 |
| 2009/0027581 | A1* | 1/2009 | You et al. | 349/48 |
| 2009/0207115 | A1* | 8/2009 | Kim | 345/90 |
| 2009/0268112 | A1* | 10/2009 | Lu et al. | 349/38 |
| 2010/0032677 | A1* | 2/2010 | Lee et al. | 257/71 |
| 2010/0066658 | A1* | 3/2010 | Kim et al. | 345/98 |
| 2010/0110319 | A1* | 5/2010 | Chen et al. | 349/38 |
| 2010/0220116 | A1* | 9/2010 | Liao et al. | 345/690 |

FOREIGN PATENT DOCUMENTS

| | | | |
|---|---|---|---|
| CN | 101404134 | A | 4/2009 |
| JP | 4223428 | A | 8/1992 |
| JP | 2004191574 | A | 7/2004 |
| JP | 2006500617 | A | 1/2006 |

* cited by examiner

*Primary Examiner* — Hong Zhou
(74) *Attorney, Agent, or Firm* — Morris Manning & Martin LLP; Tim Tingkang Xia, Esq.

(57) ABSTRACT

A liquid crystal display (LCD) and methods of driving same. In one embodiment, the LCD) includes a plurality of gate lines, $\{G_n\}$, spatially arranged along a row direction; a plurality of data lines, $\{D_m\}$, spatially arranged along a column direction perpendicular to the row direction, and a plurality of pixels, $\{P_{n,m}\}$, spatially arranged in the form of a matrix, where m=1, 2, . . . , M, n=1, 2, . . . , N, and M and N are positive integers. Each pixel $P_{n,m}$ is defined between two neighboring gate lines $G_n$ and $G_{n+1}$ and two neighboring data lines $D_m$ and $D_{m+1}$, and comprises a first sub-pixel electrode, a second sub-pixel electrode, a first transistor having a gate electrically coupled to the gate line $G_{n+1}$, a source and a drain electrically coupled to the first sub-pixel electrode, a second transistor having a gate electrically coupled to the gate line $G_n$, a source electrically coupled to the source of the first transistor and a drain electrically coupled to the second sub-pixel electrode, and a third transistor having a gate electrically coupled to the gate line $G_{n+2}$, a source electrically coupled to one of the two neighboring data lines $D_m$ and $D_{m+1}$ and a drain electrically coupled to the sources of the first and second transistors.

24 Claims, 7 Drawing Sheets

(b)

(a)

LIQUID CRYSTAL DISPLAY AND METHODS OF DRIVING SAME

FIELD OF THE INVENTION

The present invention relates generally to a liquid crystal display (LCD), and more particularly, to an LCD that utilizes an HSD3 driving scheme to reduce power consumption and improve performance and methods of driving same.

BACKGROUND OF THE INVENTION

A liquid crystal display (LCD) device includes an LCD panel formed with liquid crystal cells and pixel elements with each associating with a corresponding liquid crystal cell and having a liquid crystal (LC) capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, gate signals are sequentially applied to the number of pixel rows for sequentially turning on the pixel elements row-by-row. When a gate signal is applied to a pixel row to turn on corresponding TFTs of the pixel elements of a pixel row, source signals (i.e., image signals) for the pixel row are simultaneously applied to the number of pixel columns so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

It is known if a substantially high voltage potential is applied in the liquid crystal layer for a long period of time, the optical transmission characteristics of the liquid crystal molecules may change. This change may be permanent, causing an irreversible degradation in the display quality of the LCD. In order to prevent the LC molecules from being deteriorated, an LCD device is usually driven by using techniques that alternate the polarity of the voltages applied across a LC cell. These techniques may include inversion schemes such as frame inversion, row inversion, column inversion, and dot inversion. Typically, notwithstanding the inversion schemes, a higher image quality requires higher power consumption because of frequent polarity conversions. Such LCD devices, in particular thin film transistor (TFT) LCD devices, may consume significant amounts of power.

Approaches for reducing the power consumption of an LCD exist, such as a half source driving configuration of pixels, as shown in FIG. 6, which is referred to HSD2 in the disclosure. FIG. 6(*a*) shows waveforms of gate signals $g_1$ and $g_2$ sequentially applied to gate lines G1 and G2 of the LCD, respectively. FIGS. 6(*b*)-(*f*) show corresponding charging and holding processes of two sub-pixels P1 and P2 defined by two gate lines G1 and G2 and two data lines D1 and D2. For such an approach, during the timing sequences (states), t0, t1, . . . , and t4, the sub-pixel P2 has twice feed-throughs but the sub-pixel P1 has only one feed-through. Accordingly, the potential voltages charged in the sub-pixels P1 and P2 are different. The non-uniformity of the potential voltages in the sub-pixels P1 and P2 cause the mura effect, a defect in intensity in displayed images.

Therefore, a heretofore unaddressed need exists in the art to address the aforementioned deficiencies and inadequacies.

SUMMARY OF THE INVENTION

The present invention, in one aspect, relates to an LCD. In one embodiment, the LCD includes a plurality of gate lines, $\{G_n\}$, n=1, 2, . . . , N, N being an integer greater than zero, spatially arranged along a row direction, a plurality of data lines, $\{D_m\}$, m=1, 2, . . . , M, M being an integer greater than zero, spatially arranged crossing the plurality of gate lines $\{G_n\}$ along a column direction perpendicular to the row direction, and a plurality of pixels, $\{P_{n,m}\}$, spatially arranged in the form of a matrix.

Each pixel $P_{n,m}$ is defined between two neighboring gate lines $G_n$ and $G_{n+1}$ and two neighboring data lines $D_m$ and $D_{m+1}$, and comprises a first sub-pixel electrode, a second sub-pixel electrode, a first transistor having a gate electrically coupled to the gate line $G_{n+1}$, a source and a drain electrically coupled to the first sub-pixel electrode, a second transistor having a gate electrically coupled to the gate line $G_n$, a source electrically coupled to the source of the first transistor and a drain electrically coupled to the second sub-pixel electrode, and a third transistor having a gate electrically coupled to the gate line $G_{n+2}$, a source electrically coupled to one of the two neighboring data lines $D_m$ and $D_{m+1}$ and a drain electrically coupled to the sources of the first and second transistors. In one embodiment, the source of the third transistor of the pixel $P_{n,m}$ is electrically coupled to the data line $D_m$. In another embodiment, the source of the third transistor of the pixel $P_{n,m}$ is electrically coupled to the data line $D_m$ when n is an odd positive integer, or electrically coupled to the data line $D_{m+1}$ when n is an even positive integer.

Additionally, the LCD also includes a gate driver for generating a plurality of gate signals respectively applied to the plurality of gate lines $\{G_n\}$, wherein the plurality of gate signals is configured to turn on the transistors connected to the plurality of gate lines $\{G_n\}$ in a predefined sequence, and a data driver for generating a plurality of data signals respectively applied to the plurality of data lines $\{D_m\}$, wherein the plurality of data signals is configured such that any two neighboring data signals have inverted polarities. Each of the plurality of gate signals is configured to have a waveform. The waveform has a first voltage potential $V_1$ in a first duration, $\Gamma_1$, a second voltage potential $V_2$ in a second duration, $\Gamma_2$, a third voltage potential $V_3$ in a third duration, $\Gamma_3$, a fourth voltage potential $V_4$ in a fourth duration, $\Gamma_4$, and a fifth voltage potential $V_5$ in a fifth duration, $\Gamma_5$, where the (j+1)-th duration $\Gamma_{j+1}$ is immediately after the j-th duration $\Gamma_j$, j=1, 2, 3 and 4, $V_1=V_3=V_5>V_2=V_4$, $\Gamma_2=\Gamma_1/2$, $\Gamma_3=(\Gamma_1-t)/2$, $\Gamma_4=t$, $\Gamma_5=\Gamma_3$, and $\Gamma_1>>t$. In one embodiment, the waveform of each of the gate signals is sequentially shifted from one another by the duration of $\Gamma_1$.

In one embodiment, the LCD further includes at least one common electrode formed in relation to the first and second sub-pixel electrodes of each pixel $P_{n,m}$.

In one embodiment, each pixel $P_{n,m}$ further comprises a liquid crystal (LC) capacitor, a second LC capacitor, a first storage capacitor and a second storage capacitor. The first LC capacitor and the first storage capacitor are electrically coupled between the first sub-pixel electrode and the at least one common electrode in parallel. The second LC capacitor and the second storage capacitor are electrically coupled between the second sub-pixel electrode and the at least one common electrode in parallel.

In one embodiment, the first sub-pixel electrode, the first transistor, the first LC capacitor, and the first storage capacitor of each pixel $P_{n,m}$ define a first sub-pixel, $P_{n,m}$(1), of the pixel $P_{n,m}$. The second sub-pixel electrode, the second transistor, the second LC capacitor, and the second storage capacitor of each pixel $P_{n,m}$ define a second sub-pixel, $P_{n,m}$(2), of the pixel $P_{n,m}$.

In another aspect, the present invention relates to a method of driving an LCD. In one embodiment, the method includes the step of providing an LCD comprising a plurality of gate lines, $\{G_n\}$, n=1, 2, . . . , N, N being an integer greater than zero, spatially arranged along a row direction, a plurality of data lines, $\{D_m\}$, m=1, 2, . . . , M, M being an integer greater than zero, spatially arranged crossing the plurality of gate lines $\{G_n\}$ along a column direction perpendicular to the row direction, and a plurality of pixels, $\{P_{n,m}\}$, spatially arranged in the form of a matrix.

Each pixel $P_{n,m}$ is defined between two neighboring gate lines $G_n$ and $G_{n+1}$ and two neighboring data lines $D_m$ and $D_{m+1}$, and comprises a first sub-pixel electrode, a second sub-pixel electrode, a first transistor having a gate electrically coupled to the gate line $G_{n+1}$, a source and a drain electrically coupled to the first sub-pixel electrode, a second transistor having a gate electrically coupled to the gate line $G_n$, a source electrically coupled to the source of the first transistor and a drain electrically coupled to the second sub-pixel electrode, and a third transistor having a gate electrically coupled to the gate line $G_{n+2}$, a source electrically coupled to one of the two neighboring data lines $D_m$ and $D_{m+1}$ and a drain electrically coupled to the sources of the first and second transistors. In one embodiment, the source of the third transistor of the pixel $P_{n,m}$ is electrically coupled to the data line $D_m$. In another embodiment, the source of the third transistor of the pixel $P_{n,m}$ is electrically coupled to the data line $D_m$ when n is an odd positive integer, or electrically coupled to the data line $D_{m+1}$ when n is an even positive integer.

The method also includes the step of applying a plurality of gate signals to the plurality of gate lines $\{G_n\}$ and a plurality of data signals to the plurality of data lines $\{D_m\}$, respectively, wherein the plurality of gate signals is configured to turn on the transistors connected to the plurality of gate lines $\{G_n\}$ in a predefined sequence, and the plurality of data signals is configured such that any two neighboring data signals have inverted polarities.

In one embodiment, each of the plurality of gate signals is configured to have a waveform. The waveform has a first voltage potential $V_1$ in a first duration, $\Gamma_1$, a second voltage potential $V_2$ in a second duration, $\Gamma_2$, a third voltage potential $V_3$ in a third duration, $\Gamma_3$, a fourth voltage potential $V_4$ in a fourth duration, $\Gamma_4$, and a fifth voltage potential $V_5$ in a fifth duration, $\Gamma_5$, where the (j+1)-th duration $\Gamma_{j+1}$ is immediately after the j-th duration $\Gamma_j$, j=1, 2, 3 and 4, $V_1=V_3=V_5>V_2=V_4$, $\Gamma_2=\Gamma_1/2$, $\Gamma_3=(\Gamma_1-t)/2$, $\Gamma_4=t$, $\Gamma_5=\Gamma_3$, and $\Gamma_1>>t$. In one embodiment, the waveform of each of the gate signals is sequentially shifted from one another by the duration of $\Gamma_1$.

In yet another aspect, the present invention relates to an LCD. In one embodiment, the LCD panel comprises a plurality of pixels, $\{P_{n,m}\}$, spatially arranged in the form of a matrix, n=1, 2, . . . , N, and m=1, 2, . . . , M, and N, M being an integer greater than zero. Each pixel $P_{n,m}$ includes a first sub-pixel electrode, a second sub-pixel electrode, a first switching element electrically coupled to the first sub-pixel electrode, a second switching element electrically coupled to the second sub-pixel electrode, and a third switching element electrically coupled to the first and second switching elements.

The LCD further comprises a plurality of gate lines, $\{G_n\}$, spatially arranged along a row direction. Each pair of two neighboring gate lines $G_n$ and $G_{n+1}$ defines a pixel row $P_{n,\{m\}}$ of the pixel matrix $\{P_{n,m}\}$ therebetween and is electrically coupled to the first and second switching elements of each pixel in the pixel row $P_{n,\{m\}}$, respectively.

The LCD also comprises a plurality of data lines, $\{D_m\}$, spatially arranged crossing the plurality of gate lines $\{G_n\}$ along a column direction perpendicular to the row direction. Each pair of two neighboring data lines $D_m$ and $D_{m+1}$ defines a pixel column, $P_{\{n\},m}$, of the pixel matrix $\{P_{n,m}\}$ therebetween, and is electrically coupled to the third switching element of each pixel $P_{n,m}$ in the pixel column, $P_{\{n\},m}$.

Moreover, the LCD includes a gate driver for generating a plurality of gate signals respectively applied to the plurality of gate lines $\{G_n\}$, wherein the plurality of gate signals is configured to turn on the switching elements connected to the plurality of gate lines $\{G_n\}$ in a predefined sequence, and a data driver for generating a plurality of data signals respectively applied to the plurality of data lines $\{D_m\}$, wherein the plurality of data signals is configured such that any two neighboring data signals have inverted polarities.

In one embodiment, the first sub-pixel electrode and the first switching element of each pixel $P_{n,m}$ define a first sub-pixel, $P_{n,m}(\mathbf{1})$, of the pixel $P_{n,m}$. The second sub-pixel electrode and the second switching element of each pixel $P_{n,m}$ define a second sub-pixel, $P_{n,m}(\mathbf{2})$, of the pixel $P_{n,m}$.

In one embodiment, each of the first, second and third switching elements of the pixel $P_{n,m}$ of the pixel matrix $\{P_{n,m}\}$ is a field-effect thin film transistor having a gate, a source and a drain. The gate, the source and the drain of the first switching element of the pixel $P_{n,m}$ are electrically coupled to the gate line $G_{n+1}$, the source of the second switching element of the pixel $P_{n,m}$, and the first sub-pixel electrode of the pixel $P_{n,m}$, respectively. The gate, the source and the drain of the second switching element of the pixel $P_{n,m}$ are electrically coupled to the gate line $G_n$, the source of the first switching element of the pixel $P_{n,m}$, and the second sub-pixel electrode of the pixel $P_{n,m}$, respectively. In one embodiment, the gate, the source and the drain of the third switching element of the pixel $P_{n,m}$ are electrically coupled to the gate line $G_{n+2}$, the data line $D_m$, and the sources of the first and second switching elements of the pixel $P_{n,m}$, respectively. In another embodiment, the gate and the drain of the third switching element of the pixel $P_{n,m}$ are electrically coupled to the gate line $G_{n+2}$ and the sources of the first and second switching elements of the pixel $P_{n,m}$, respectively, while the source of the third transistor of the pixel $P_{n,m}$ is electrically coupled to the data line $D_m$ when n is an odd positive integer, or electrically coupled to the data line $D_{m+1}$ when n is an even positive integer.

In a further aspect, the present invention relates to a method of driving an LCD. In one embodiment, the method includes the step of providing an LCD comprising (a) a plurality of pixels, $\{P_{n,m}\}$, spatially arranged in the form of a matrix, n=1, 2, . . . , N, and m=1, 2, . . . , M, and N, M being an integer greater than zero, each pixel $P_{n,m}$ comprising a first sub-pixel electrode, a second sub-pixel electrode, a first switching element electrically coupled to the first sub-pixel electrode, a second switching element electrically coupled to the second sub-pixel electrode, and a third switching element electrically coupled to the first and second switching elements, (b) a plurality of gate lines, $\{G_n\}$, spatially arranged along a row direction, wherein each pair of two neighboring gate lines $G_n$ and $G_{n+1}$ defines a pixel row $P_{n,\{m\}}$ of the pixel matrix $\{P_{n,m}\}$ therebetween and is electrically coupled to the first and second switching elements of each pixel in the pixel row $P_{n,\{m\}}$, respectively, and (c) a plurality of data lines, $\{D_m\}$, spatially arranged crossing the plurality of gate lines $\{G_n\}$ along a column direction perpendicular to the row direction. Each pair of two neighboring data lines $D_m$ and $D_{m+1}$ defines a pixel column, $P_{\{n\},m}$, of the pixel matrix $\{P_{n,m}\}$ therebetween, and is electrically coupled to the third switching element of each pixel $P_{n,m}$ in the pixel column, $P_{\{n\},m}$.

In one embodiment, each of the first, second and third switching elements of the pixel $P_{n,m}$ of the pixel matrix $\{P_{n,m}\}$ is a field-effect thin film transistor having a gate, a source and a drain. The gate, the source and the drain of the first switching element of the pixel $P_{n,m}$ are electrically coupled to the gate line $G_{n+1}$, the source of the second switching element of the pixel $P_{n,m}$, and the first sub-pixel electrode of the pixel $P_{n,m}$, respectively. The gate, the source and the drain of the second switching element of the pixel $P_{n,m}$ are electrically coupled to the gate line $G_n$, the source of the first switching element of the pixel $P_{n,m}$, and the second sub-pixel electrode of the pixel $P_{n,m}$, respectively. The gate, the source and the drain of the third switching element of the pixel $P_{n,m}$ are electrically coupled to the gate line $G_{n+2}$, the data line $D_m$, and the sources of the first and second switching elements of the pixel $P_{n,m}$, respectively. The gate, the source and the drain of the third switching element of the pixel $P_{n+1,m}$ are electrically coupled to the gate line $G_{n+3}$, the data line $D_{m+1}$, and the sources of the first and second switching elements of the pixel $P_{n+1,m}$, respectively.

The method also includes the step of applying a plurality of gate signals to the plurality of gate lines $\{G_n\}$ and a plurality of data signals to the plurality of data lines $\{D_m\}$, respectively, wherein the plurality of gate signals is configured to turn on the switching elements connected to the plurality of gate lines $\{G_n\}$ in a predefined sequence, and the plurality of data signals is configured such that any two neighboring data signals have inverted polarities.

In one embodiment, each of the plurality of gate signals is configured to have a waveform. The waveform has a first voltage potential $V_1$ in a first duration, $\Gamma_1$, a second voltage potential $V_2$ in a second duration, $\Gamma_2$, a third voltage potential $V_3$ in a third duration, $\Gamma_3$, a fourth voltage potential $V_4$ in a fourth duration, $\Gamma_4$, and a fifth voltage potential $V_5$ in a fifth duration, $\Gamma_5$, where the (j+1)-th duration $\Gamma_{j+1}$ is immediately after the j-th duration $\Gamma_j$, j=1, 2, 3 and 4, $V_1=V_3=V_5>V_2=V_4$, $\Gamma_2=\Gamma_1/2$, $\Gamma_3=(\Gamma_1-t)/2$, $\Gamma_4=t$, $\Gamma_5=\Gamma_3$, and $\Gamma_1>>t$. The waveform of each of the gate signals is sequentially shifted from one another by the duration of $\Gamma_1$.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, wherein.

DETAILED DESCRIPTION OF THE INVENTION

Figure 1:
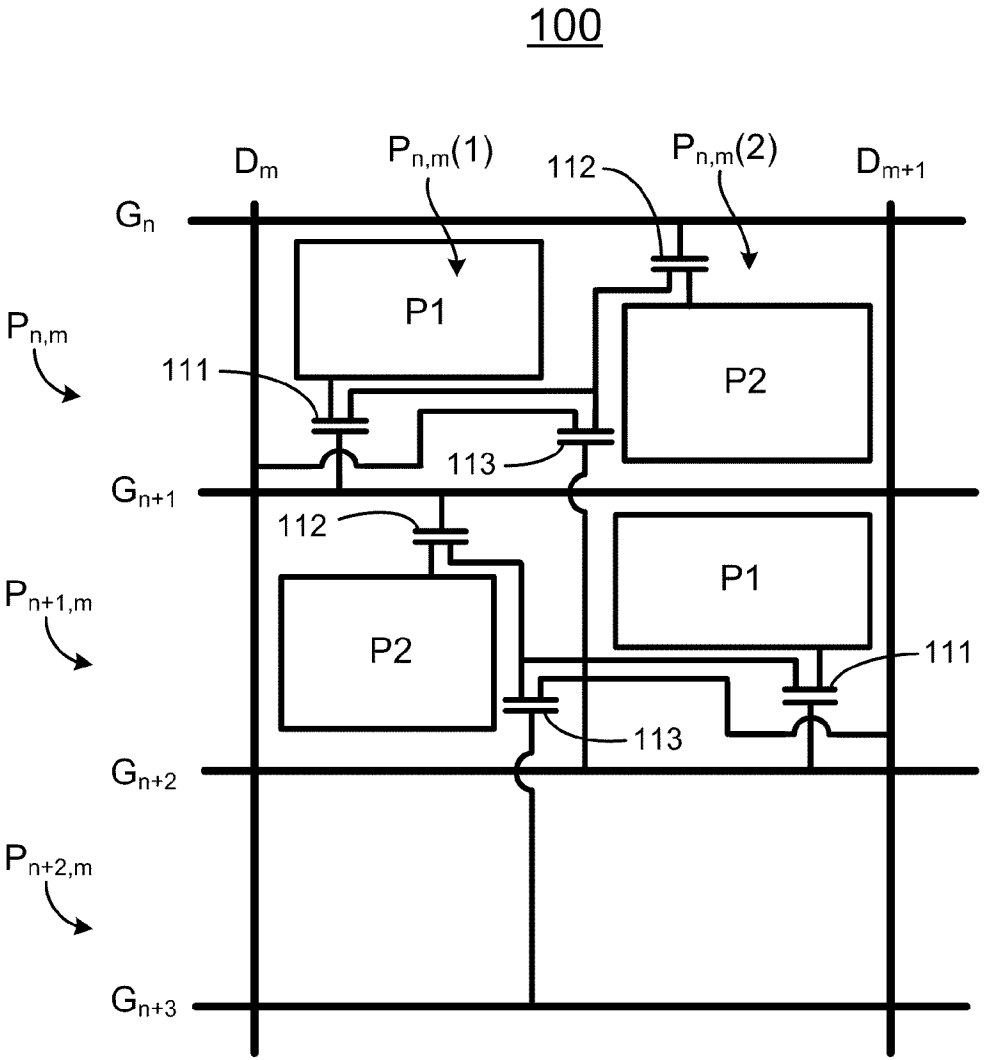
FIG. 1 shows schematically a partial layout view of an LCD according to one embodiment of the present invention.

The present disclosure is more particularly described in the following examples that are intended as illustrative only since numerous modifications and variations therein will be apparent to those skilled in the art. Various embodiments of the disclosure are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "having," "containing," "involving," and the like are to be understood to be open-ended, i.e., to mean including but not limited to.

The term "HSD2", as used herein, refers to a pixel arrangement and driving scheme of an LCD in which each pixel defined two neighboring gate lines is configured to have first and second switches electrically coupled to the two neighboring gate lines, respectively. The term "HSD3", as used herein, refers to a pixel arrangement and driving scheme of an LCD in which each pixel defined two neighboring gate lines is configured to have first, second and third switches. The first and second switches are electrically coupled to the two neighboring gate lines, respectively, while the third switch is electrically coupled to the first and second switches and a third gate line that is immediately next to the two neighboring gate lines.

The description will be made as to the embodiments of the present invention in conjunction with the accompanying drawings in FIGS. 1-6. In accordance with the purposes of this invention, as embodied and broadly described herein, this invention, in one aspect, relates to an LCD that utilizes an HSD3 driving scheme to reduce power consumption and improve performance and methods of driving same.

Referring to FIG. 1, an LCD panel 100 according to one embodiment of the present invention is partially and schematically shown. The LCD panel 100 includes a plurality of gate lines, $G_1, G_2, \ldots, G_n, G_{n+1}, G_{n+2}, G_{n+3}, \ldots, G_N$, that are spatially arranged along a row (horizontal) direction, and a plurality of data lines, $D_1, D_2, \ldots, D_m, D_{m+1}, D_{m+2}, D_{m+3}, \ldots, D_M$, that are spatially arranged crossing the plurality of gate lines $G_1, G_2, \ldots, G_n, G_{n+1}, G_{n+2}, G_{n+3}, \ldots, G_N$ along a column (vertical) direction that is perpendicular to the row direction. N and M are integers greater than one. The LCD panel 100 further has a plurality of pixels, $\{P_{n,m}\}$, that is spatially arranged in the form of a matrix. Each pixel $P_{n,m}$ is defined between two neighboring gate lines $G_n$ and $G_{n+1}$ and two neighboring data lines $D_m$ and $D_{m+1}$. For the purpose of illustration of embodiments of the present invention, FIG. 1 schematically shows only four gate lines $G_n$, $G_{n+1}$, $G_{n+2}$ and $G_{n+3}$, two data lines $D_m$, and $D_{m+1}$, and three corresponding pixels of the LCD panel 100.

The pixel $P_{n,m}$ located, for example, between two neighboring gate lines $G_n$ and $G_{n+1}$ and two neighboring data lines $D_m$ and $D_{m+1}$ crossing the two neighboring gate lines $G_n$ and $G_{n+1}$, has a first sub-pixel electrode P1, a second sub-pixel electrode P2, a first transistor 111, a second transistor 112 and a third transistor 113.

Figure 5:
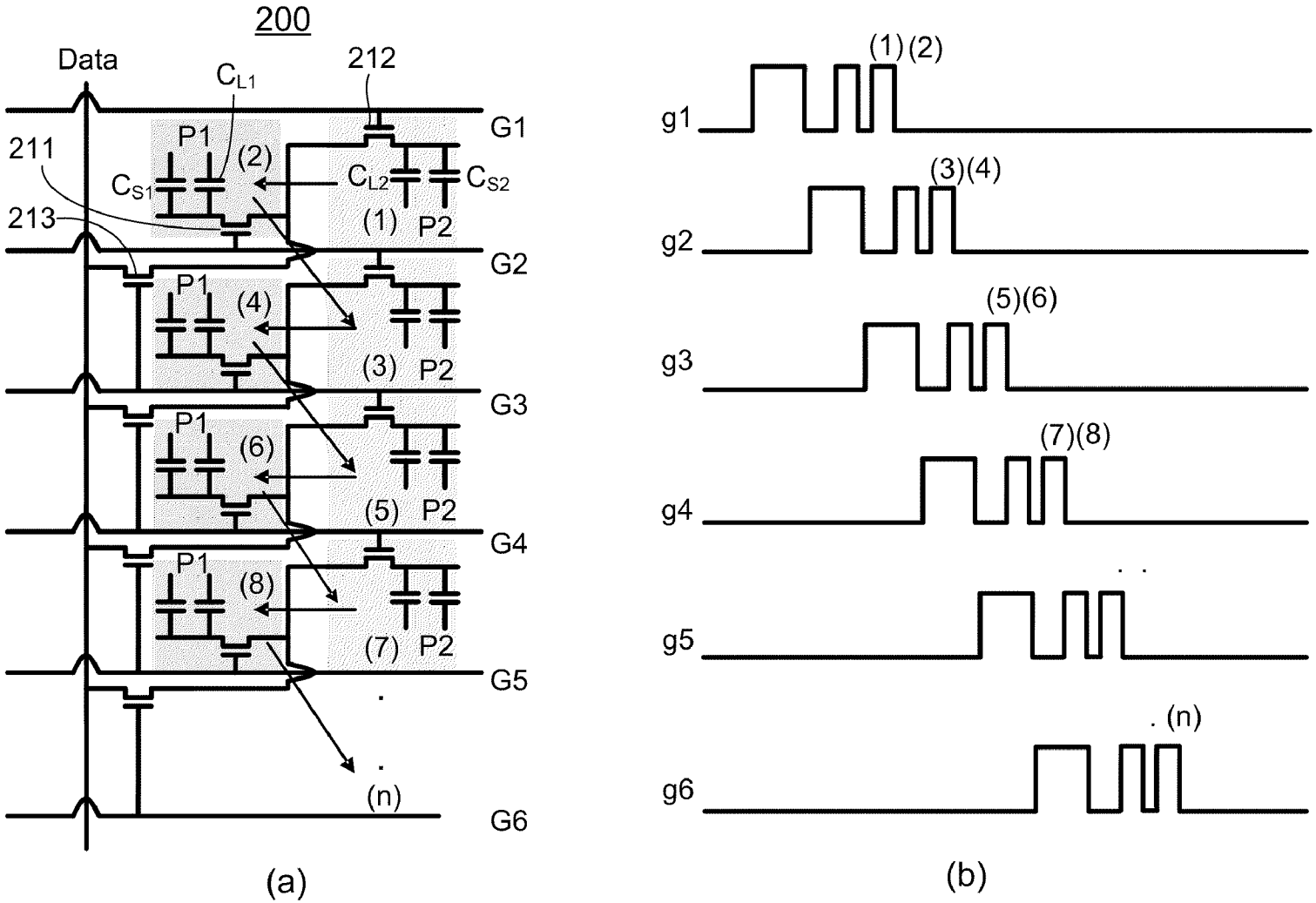
FIG. 5 shows schematically an LCD according to another embodiment of the present invention, (a) an equivalent circuit diagram, and (b) time charts of driving signals.

The first transistor 111 has a gate electrically coupled to the gate line $G_{n+1}$, a source and a drain electrically coupled to the first sub-pixel electrode P1. The second transistor 112 has a gate electrically coupled to the gate line $G_n$, a source electrically coupled to the source of the first transistor 111 and a drain electrically coupled to the second sub-pixel electrode P2. The third transistor 113 has a gate electrically coupled to the gate line $G_{n+2}$, a source electrically coupled to one of the two neighboring data lines $D_m$ and $D_{m+1}$ and a drain electrically coupled to the sources of the first and second transistors 111 and 112. In the exemplary embodiment shown in FIG. 1, the source of the third transistor 113 of the pixel $P_{n,m}$ is electrically coupled to the data line $D_m$ when n is an odd positive integer, or electrically coupled to the data line $D_{m+1}$ when n is an even positive integer. In another embodiment as shown in FIG. 5 below, the source of the third transistor 113 of the pixel $P_{n,m}$ is electrically coupled to the data line $D_m$.

Additionally, the LCD 100 also includes at least one common electrode (not shown) formed in relation to the first and second sub-pixel electrodes P1 and P2 of each pixel $P_{n,m}$. As shown in FIG. 5 below, each pixel $P_{n,m}$ may further include a first LC capacitor, $C_{L1}$, a second LC capacitor, $C_{L2}$, a first storage capacitor, $C_{S1}$, and a second storage capacitor, $C_{S2}$. The first LC capacitor $C_{L1}$ and the first storage capacitor $C_{S1}$ are electrically coupled between the first sub-pixel electrode P1 and the at least one common electrode in parallel. The second LC capacitor $C_{L2}$ and the second storage capacitor $C_{S2}$ are electrically coupled between the second sub-pixel electrode P2 and the at least one common electrode in parallel.

Alternatively, each pixel $P_{n,m}$ is configured to have two or more sub-pixels. The first sub-pixel electrode P1, the first transistor 111, the first LC capacitor $C_{L1}$ and the first storage capacitor $C_{S1}$ of each pixel $P_{n,m}$ define a first sub-pixel, $P_{n,m}$(1), of the pixel $P_{n,m}$, while the second sub-pixel electrode P2, the second transistor 112, the second LC capacitor $C_{L2}$ and the second storage capacitor $C_{S2}$ of each pixel $P_{n,m}$ define a second sub-pixel, $P_{n,m}$(2), of the pixel $P_{n,m}$. The first, second and third transistors 111, 112 and 113 in one embodiment are field-effect TFTs and adapted for activating the first sub-pixel $P_{n,m}$(1) and the second sub-pixel $P_{n,m}$(2), respectively. Other types of transistors may also be utilized to practice the present invention.

In one embodiment, the sub-pixel electrodes P1/P2 of the first sub-pixel $P_{n,m}$(1) and the second sub-pixel $P_{n,m}$(2) of each pixel $P_{n,m}$ are deposited on a first substrate (not shown), while the common electrode is deposited on a second substrate (not shown) that is spatially apart from the first substrate. The LC molecules are filled into cells between the first and second substrates. Each cell is associated with a pixel $P_{n,m}$ of the LCD 100. Voltages (potentials) applied to the sub-pixel electrodes P1 and P2 control orientation alignments of the LC molecules in the LC cells associated with the corresponding sub-pixels.

The LCD 100 further has a gate driver and a data driver (not shown). The gate driver is adapted for generating a plurality of gate signals, $\{g_n\}$, respectively applied to the plurality of gate lines $\{G_n\}$. The plurality of gate signals $\{g_n\}$ is configured to turn on the first, second and third transistors 111, 112 and 113 connected to the plurality of gate lines $\{G_n\}$ in a predefined sequence. The data driver is adapted for generating a plurality of data signals, $\{d_m\}$, respectively applied to the plurality of data lines $\{D_m\}$.

Figure 2:
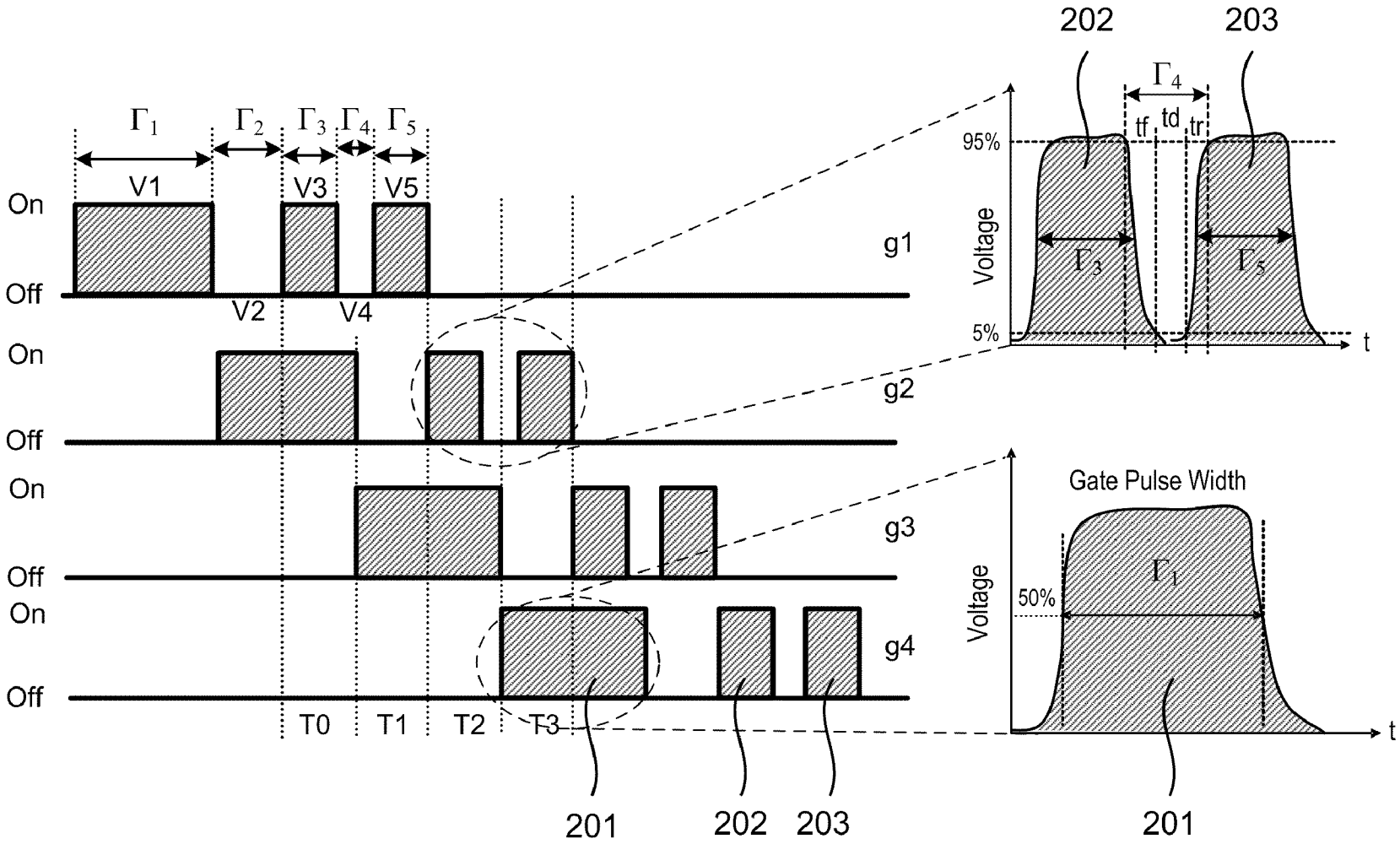
FIG. 2 shows time charts of driving signals applied to the LCD shown in FIG. 1.

Referring to FIG. 2, waveform/time charts of the gate signals $g_1$, $g_2$, $g_3$ and $g_4$ applied to the LCD shown in FIG. 1 and charging in the corresponding sub-pixel electrodes P1 and P2 of the LCD are shown according to one embodiment of the present invention. Each of the gate signals $g_1$, $g_2$, $g_3$ and $g_4$ is configured to have a waveform. The waveform has a first voltage potential $V_1$ in a first duration, $\Gamma_1$, a second voltage potential $V_2$ in a second duration, $\Gamma_2$, a third voltage potential $V_3$ in a third duration, $\Gamma_3$, a fourth voltage potential $V_4$ in a fourth duration, $\Gamma_4$, and a fifth voltage potential $V_5$ in a fifth duration, $\Gamma_5$, where the (j+1)-th duration $\Gamma_{j+1}$ is immediately after the j-th duration $\Gamma_j$, j=1, 2, 3 and 4, $V_1=V_3=V_5>V_2=V_4$, $\Gamma_2=\Gamma_1/2$, $\Gamma_3=(\Gamma_1-t)/2$, $\Gamma_4=t$, $\Gamma_5=\Gamma_3$, and $\Gamma_1>>t\geqq\Gamma_1/40$. In this embodiment, $V_1$ ($V_3$, $V_5$) and $V_2$ ($V_4$) are corresponding to a high voltage potential and a low voltage potential, respectively, for effectively turning on and off the corresponding transistors of a corresponding pixel row. The waveform of each of the gate signals $g_1$, $g_2$, $g_3$ and $g_4$ is sequentially shifted from one another so as to activate the three pixel rows in a predetermined order (sequence). In this exemplary embodiment, the gate signal $g_2$ is shifted by the duration of $\Gamma_1$ from the gate signal $g_1$; the gate signal $g_3$ is shifted by the duration of $\Gamma_1$ from the gate signal $g_2$; and the gate signal $g_4$ is shifted by the duration of $\Gamma_1$ from the gate signal $g_3$, respectively. Usually, the waveform of each gate signal is characterized with a plurality of pulses, for example, pulses 201, 202 and 203. Each pulse has a pulse width and height. Specifically, the pulse width and height of the pulse 201 define the first duration $\Gamma_1$ and the first voltage potential $V_1$, respectively; the pulse width and height of the pulse 202 define the third duration $\Gamma_3$ and the third voltage potential $V_3$, respectively; and the pulse width and height of the pulse 203 define the fifth duration $\Gamma_5$ and the fifth voltage potential $V_5$, respectively. The separation between the pulses 201 and 202 defines the second duration $\Gamma_2$, while the separation between the pulses 202 and 203 defines the fourth duration $\Gamma_4$. In one embodiment, $\Gamma_1>>\Gamma_4(=t)>\Gamma_1/40$.

Figure 3:
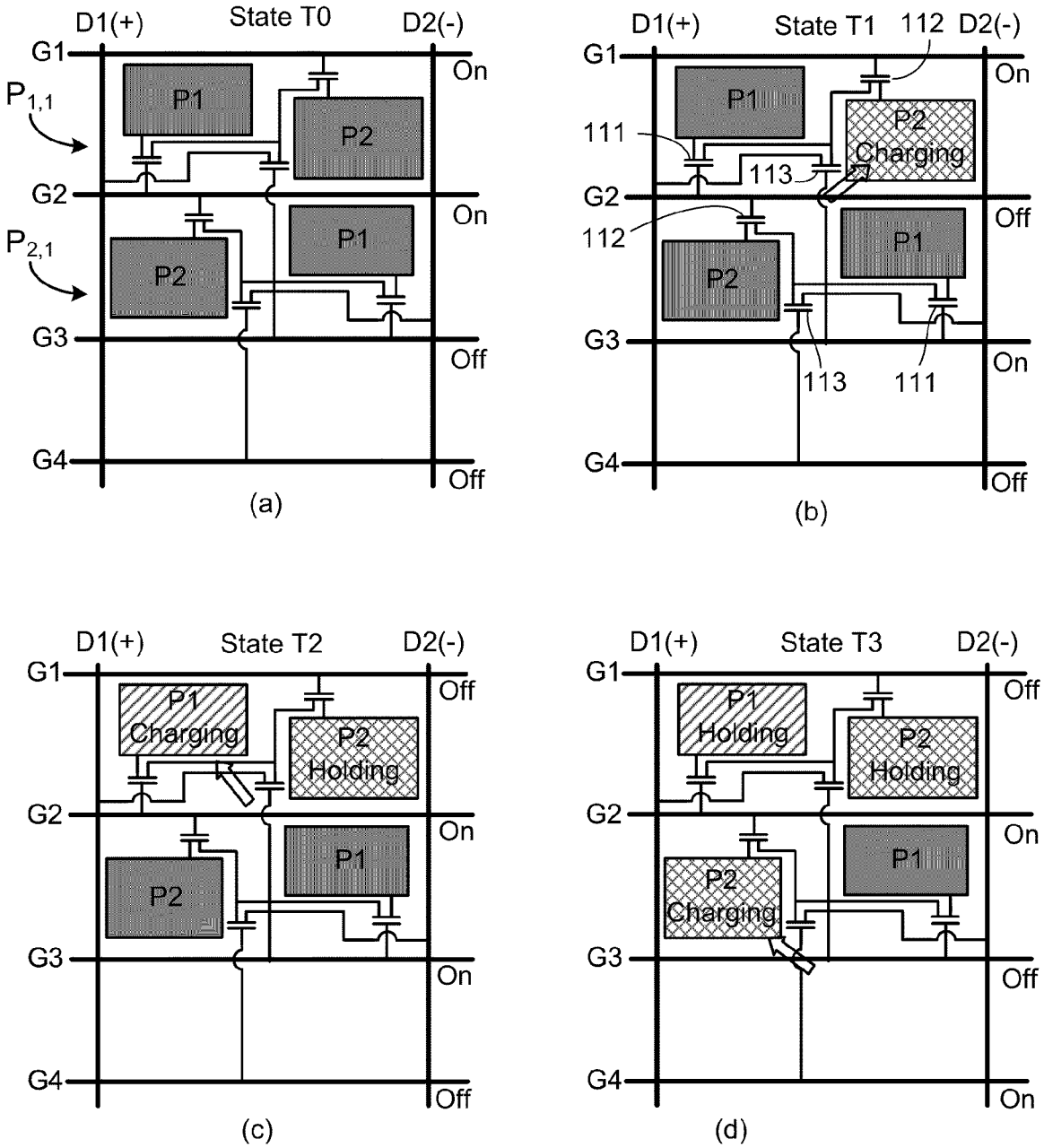
FIG. 3 shows schematically pixel charging and holding processes (a)-(d) of the LCD shown in FIG. 1.

As shown in FIG. 3, when such gate signals $g_1$, $g_2$, $g_3$ and $g_4$ are applied to the gate lines $G_1$, $G_2$, $G_3$, and $G_4$, respectively, of the LCD shown in FIG. 1, the second feed-through effect on the first sub-pixel or the second sub-pixel will be avoided in operation.

For example, in the time period of T0, the gates $G_1$ and $G_2$ are turned on, while the gates $G_3$ and $G_4$ are turned off. Accordingly, the third transistors 113 of both the pixels $P_{1,1}$ and $P_{2,1}$ are turned off. Thus, no data signals are applied to the first and second sub-pixels of the pixels $P_{1,1}$ and $P_{2,1}$ through the data line $D_1$ or $D_2$. This is corresponding to State T0, as shown in FIG. 3(*a*).

In the time period of T1, the gates $G_1$ and $G_3$ are turned on, while the gates $G_2$ and $G_4$ are turned off. Accordingly, the second transistor 112 and the third transistor 113 of the pixel $P_{1,1}$ are turned on, whereby the data signal is applied to the second sub-pixel of the pixel $P_{1,1}$ through the data line $D_1$, and the second sub-pixel electrode P2 of the pixel $P_{1,1}$ is charged. This is corresponding to State T1, as shown in FIG. 3(*b*).

In the time period of T2, the gates $G_2$ and $G_3$ are turned on, while the gates $G_1$ and $G_4$ are turned off. Accordingly, the first transistor 111 and the third transistor 113 of the pixel $P_{1,1}$ are turned on, whereby the data signal is applied to the first sub-pixel of the pixel $P_{1,1}$ through the data line $D_1$, and the first sub-pixel electrode P1 of the pixel $P_{1,1}$ is charged and the second sub-pixel electrode P2 of the pixel $P_{1,1}$ is held. This is corresponding to State T2, as shown in FIG. 3(*c*).

In the time period of T3, the gates $G_2$ and $G_4$ are turned on, while the gates $G_1$ and $G_3$ are turned off. Accordingly, the second transistor 112 and the third transistor 113 of the pixel $P_{2,1}$ are turned on, whereby the data signal is applied to the second sub-pixel of the pixel $P_{2,1}$ through the data line $D_2$, and the second sub-pixel electrode P2 of the pixel $P_{2,1}$ is charged, and the first and second sub-pixel electrodes P1 and P2 of the pixel $P_{1,1}$ are held. This is corresponding to State T3, as shown in FIG. 3(*d*).

Figure 4:
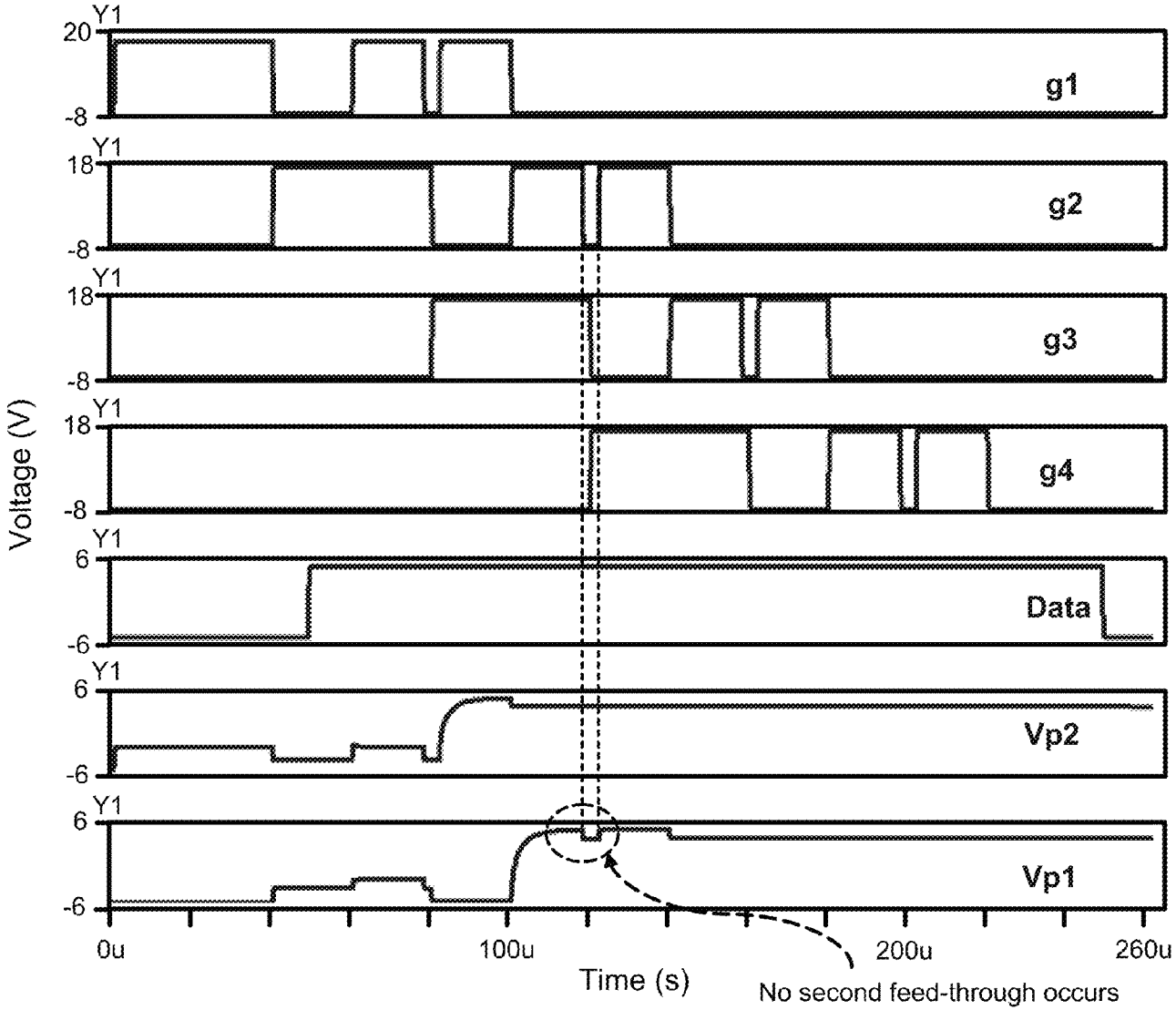
FIG. 4 shows simulation results of the pixel voltage potentials of the LCD for the gate signals shown in FIG. 1.

FIG. 4 and Table 1 show simulation results for the gate signals $g_1$, $g_2$, $g_3$ and $g_4$ having a waveform same as that shown in FIG. 2. The final voltages charged in the sub-pixels P1 and P2 are almost identical. Thus, The HSD3 driving scheme according to the present invention has more uniform charging and better holding performance comparing to the HSD2 driving scheme.

TABLE 1

Simulation Results of the LCD at Frame Rate = 50 Hz.

| Driving Method | Sub-Pixel | Charging Check $T_{ch}$ | W/L | $V_p$ (Charging Ratio) | After Feed-Through $V_p'$ | Holding Check (Leakage Current) $T_{hold}$ | $V_{hold}$ | ΔV |
|---|---|---|---|---|---|---|---|---|
| HSD2 | P1 | 33us | 210 um/ 5 um | 14.76 V (99.2%) | 12.78 V | 19.96 ms | 11.77 V | −1.02 V |
| | P2 | | | 11.19 V (87.3%) | 9.05 V | | 9.31 V | +0.26 V |
| HSD3 | P1 | 33us | 210 um/ 5 um | 12.44 V (91.5%) | 10.11 V | 19.96 ms | 9.804 V | −0.185 V |
| | P2 | | | 12.44 V (91.5%) | 10.15 V | | 9.848 V | −0.181 V |

(Tch is the pixel charging time; W/L represents the sub-pixel width and length; $V_p$ and $V_p'$ are the sub-pixel voltages; Thold is the holding time; Vhold is the holding voltages; and ΔV represents the voltage difference between $V_p'$ and Vhold.)

FIG. 5(*a*) shows partially and schematically an LCD 200 according to another embodiment of the present invention. The configuration of the LCD 200 is same as that of the LCD 100 shown in FIG. 1, except that the source of the third transistor 213 of each pixel $P_{n,m}$ is electrically coupled to the data line $D_m$. FIG. 5(*b*) shows time charts of the gate signals $g_1$, $g_2$, . . . , and $g_6$ sequentially applied to the gate line G1, G2, . . . , and G6, respectively, of the LCD. Each of the gate signals $g_1$, $g_2$, . . . , and $g_6$ has a waveform same as that shown in FIG. 2. Accordingly, the pixel charging sequence is from sub-pixel (1) to sub-pixel (2) to sub-pixel (3), . . . , to sub-pixel (n).

Figure 6:
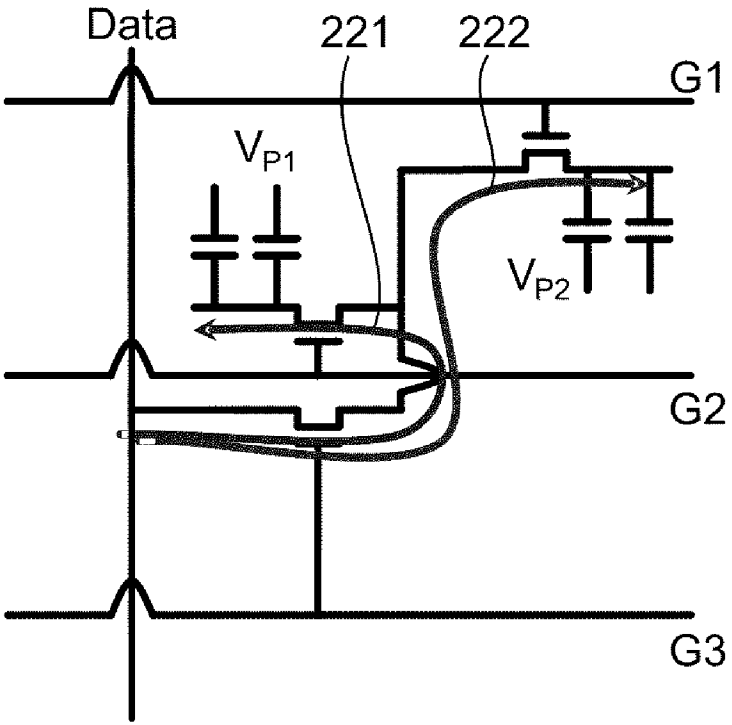
FIG. 6 shows schematically pixel charging and holding processes (a) and (b) of the LCD shown in FIG. 5.
Figure 6:
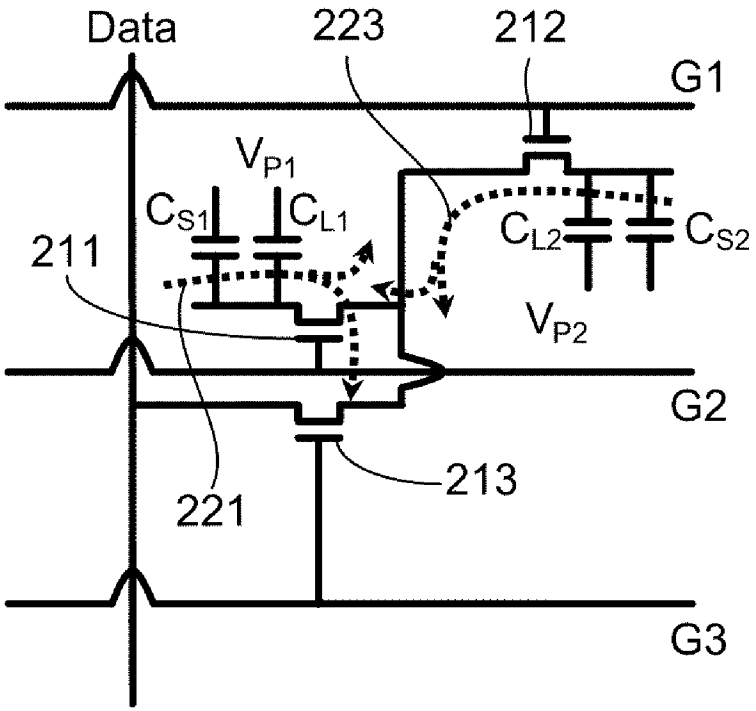
Figure 7:
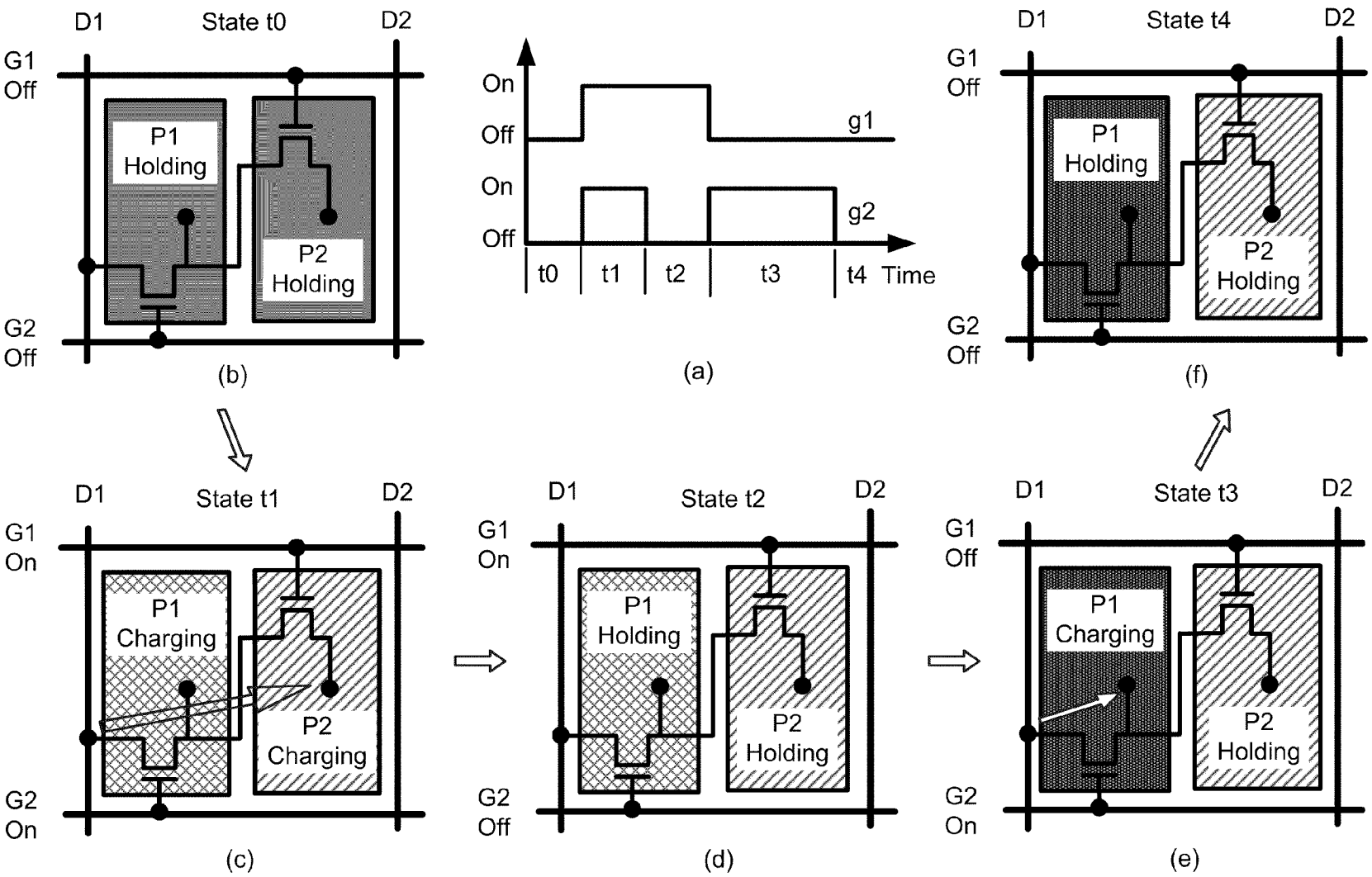
Fig. 7 (Related Art)
FIG. 7 shows time charts of driving signals (a) and pixel charging and holding processes (b)-(f) of a conventional LCD.

FIG. 6(*a*) shows pixel discharging processes of the LCD 200, indicated by the current leakage path 223, while FIG. 6(*b*) pixel charging processes of the LCD 200, indicated by the charging path 221 for the sub-pixel P1 and the charging path 222 for the sub-pixel P2.

According to the embodiments of the present invention as disclosed above, a half source channel amount is reduced and the aperture ratio is improved in the LCD with the HSD3 driving scheme, comparing to a conventional LCD. Further, the LCD of the present invention has good uniformity in charging and holding performance.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A liquid crystal display (LCD), comprising:

(a) a plurality of gate lines, $\{G_n\}$, n=1, 2, . . ., N, N being an integer greater than zero, spatially arranged along a row direction;

(b) a plurality of data lines, $\{D_m\}$, m=1, 2, . . ., M, M being an integer greater than zero, spatially arranged crossing the plurality of gate lines $\{G_n\}$ along a column direction perpendicular to the row direction; and (c) a plurality of pixels, $\{P_{n,m}\}$, spatially arranged in the form of a matrix, each pixel $P_{n,m}$ defined between two neighboring gate lines $G_n$, and $G_{n+1}$ and two neighboring data lines $D_m$ and $D_{m+1}$, and comprising:

(i) a first sub-pixel electrode;

(ii) a second sub-pixel electrode;

(iii) a first transistor having a gate electrically coupled to the gate line $G_{n+1}$, a source, and a drain electrically coupled to the first sub-pixel electrode;

(iv) a second transistor having a gate electrically coupled to the gate line $G_n$, a source electrically coupled to the source of the first transistor, and a drain electrically coupled to the second sub-pixel electrode; and (v) a third transistor having a gate electrically coupled to the gate line $G_{n+2}$, a source electrically coupled to one of the two neighboring data lines $D_m$ and $D_{m+1}$, and a drain electrically coupled to the sources of the first and second transistors.

2. The LCD of claim 1, wherein the source of the third transistor of the pixel $P_{n,m}$ is electrically coupled to the data line $D_m$.

3. The LCD of claim 1, wherein the source of the third transistor of the pixel $P_{n,m}$ is electrically coupled to the data line $D_m$ when n is an odd positive integer, or electrically coupled to the data line $D_{m+1}$ when n is an even positive integer.

4. The LCD of claim 1, further comprising at least one common electrode formed in relation to the first and second sub-pixel electrodes of each pixel $P_{n,m}$.

5. The LCD of claim 4, wherein each pixel $P_{n,m}$ further comprises a first liquid crystal (LC) capacitor, a second LC capacitor, a first storage capacitor and a second storage capacitor, wherein the first LC capacitor and the first storage capacitor are electrically coupled between the first sub-pixel electrode and the at least one common electrode in parallel, and wherein the second LC capacitor and the second storage capacitor are electrically coupled between the second sub-pixel electrode and the at least one common electrode in parallel.

6. The LCD of claim 5, wherein the first sub-pixel electrode, the first transistor, the first LC capacitor, and the first storage capacitor of each pixel $P_{n,m}$ define a first sub-pixel, $P_{n,m}(1)$, of the pixel $P_{n,m}$, while the second sub-pixel electrode, the second transistor, the second LC capacitor, and the second storage capacitor of each pixel $P_{n,m}$ define a second sub-pixel, $P_{n,m}(2)$, of the pixel $P_{n,m}$.

7. The LCD of claim 1, further comprising:

(a) a gate driver for generating a plurality of gate signals respectively applied to the plurality of gate lines $\{G_n\}$, wherein the plurality of gate signals is configured to turn on the transistors connected to the plurality of gate lines $\{G_n\}$ in a predefined sequence; and (b) a data driver for generating a plurality of data signals respectively applied to the plurality of data lines $\{D_m\}$, wherein the plurality of data signals is configured such that any two neighboring data signals have inverted polarities.

8. The LCD of claim 7, wherein each of the plurality of gate signals is configured to have a waveform, wherein the waveform has a first voltage potential $V_1$ in a first duration, $\Gamma_1$, a second voltage potential $V_2$ in a second duration, $\Gamma_2$, a third voltage potential $V_3$ in a third duration, $\Gamma_3$, a fourth voltage potential $V_4$ in a fourth duration, $\Gamma_4$, and a fifth voltage potential $V_5$ in a fifth duration, $\Gamma_5$, wherein the (j+1)-th duration $\Gamma_{j+1}$ is immediately after the j-th duration $\Gamma_j$, j =1, 2, 3 and 4, and wherein $V_1=V_3=V_5>V_2=V_4$, $\Gamma_2=\Gamma_1/2$, $\Gamma_3=(\Gamma_1-t)/2$, $\Gamma_4=t$, $\Gamma_5=\Gamma_3$, and $\Gamma_1>>t$.

9. The LCD of claim 8, wherein the waveform of each of the gate signals is sequentially shifted from one another by the duration of $\Gamma_1$.

10. A method of driving a liquid crystal display (LCD), comprising the steps of:

(a) providing an LCD panel comprising:

(i) a plurality of gate lines, $\{G_n\}$, n=1, 2, . . ., N, N being an integer greater than zero, spatially arranged along a row direction;

(ii) a plurality of data lines, $\{D_m\}$, m=1, 2, . . ., M, M being an integer greater than zero, spatially arranged crossing the plurality of gate lines $\{G_n\}$ along a column direction perpendicular to the row direction; and (iii) a plurality of pixels, $\{P_{n,m}\}$, spatially arranged in the form of a matrix, each pixel $P_{n,m}$ defined between two neighboring gate lines $G_n$ and $G_{n+1}$ and two neighboring data lines $D_m$ and $D_{m+1}$, and comprising:

a first sub-pixel electrode;

a second sub-pixel electrode;

a first transistor having a gate electrically coupled to the gate line $G_{n+1}$, a source, and a drain electrically coupled to the first sub-pixel electrode;

a second transistor having a gate electrically coupled to the gate line $G_n$, a source electrically coupled to the source of the first transistor and a drain electrically coupled to the second sub-pixel electrode; and a third transistor having a gate electrically coupled to the gate line $G_{n+2}$, a source electrically coupled to one of the two neighboring data lines $D_m$ and $D_{m+1}$ and a drain electrically coupled to the sources of the first and second transistors; and (b) applying a plurality of gate signals to the plurality of gate lines $\{G_n\}$ and a plurality of data signals to the plurality of data lines $\{D_m\}$, respectively, wherein the plurality of gate signals is configured to turn on the transistors connected to the plurality of gate lines $\{G_n\}$ in a predefined sequence, and the plurality of data signals is configured such that any two neighboring data signals have inverted polarities.

11. The method of claim 10, wherein each of the plurality of gate signals is configured to have a waveform, wherein the waveform has a first voltage potential $V_1$ in a first duration, $\Gamma_1$, a second voltage potential $V_2$ in a second duration, $\Gamma_2$, a third voltage potential $V_3$ in a third duration, $\Gamma_3$, a fourth voltage potential $V_4$ in a fourth duration, $\Gamma_4$, and a fifth voltage potential $V_5$ in a fifth duration, $\Gamma_5$, wherein the (j+1)-th duration $\Gamma_{j+1}$ is immediately after the j-th duration $\Gamma_j$, j =1, 2, 3 and 4, and wherein $V_1=V_3=V_5>V_2=V_4$, $\Gamma_2=\Gamma_1/2$, $\Gamma_3=(\Gamma_1-t)/2$, $\Gamma_4=t$, $\Gamma_5=\Gamma_3$, and $\Gamma_1>>t$.

12. The method of claim 11, wherein the waveform of each of the gate signals is sequentially shifted from one another by the duration of $\Gamma_1$.

13. A liquid crystal display (LCD), comprising:

(a) a plurality of pixels, $\{P_{n,m}\}$, spatially arranged in the form of a matrix, n =1, 2, . . N, and m=1, 2, . . M, and N, M being an integer greater than zero, each pixel $P_{n,m}$ comprising a first sub-pixel electrode, a second sub-pixel electrode, a first switching element electrically coupled to the first sub-pixel electrode, a second switching element electrically coupled to the second sub-pixel electrode, and a third switching element electrically coupled to the first and second switching elements;

(b) a plurality of gate lines, $\{G_n\}$, spatially arranged along a row direction, wherein each pair of two neighboring gate lines $G_n$, and $G_{n+1}$ defines a pixel row $P_{n,\{m\}}$ of the pixel matrix $\{P_{n,m}\}$ therebetween and is electrically coupled to the first and second switching elements of each pixel $P_{n,m}$ in the pixel row $P_{n,\{m\}}$, respectively; and (c) a plurality of data lines, $\{D_m\}$, spatially arranged crossing the plurality of gate lines $\{G_n\}$ along a column direction perpendicular to the row direction, wherein each pair of two neighboring data lines $D_m$ and $D_{m+1}$ defines a pixel column, $P_{\{n\},m}$, of the pixel matrix $\{P_{n,m}\}$ therebetween, and is electrically coupled to the third switching element of each pixel $P_{n,m}$ in the pixel column, $P_{\{n\},m}$, wherein the gate, the source and the drain of the third switching element of the pixel $P_{n,m}$ are electrically coupled to the gate line $G_{n+2}$, the data line $D_m$, and the sources of the first and second switching elements of $P_{n,m}$, respectively.

14. The LCD of claim 13, wherein the first sub-pixel electrode and the first switching element of the pixel $P_{n,m}$ define a first sub-pixel, $P_{n,m}(1)$, of the pixel $P_{n,m}$, while the second sub-pixel electrode and the second switching element of the pixel $P_{n,m}$ define a second sub-pixel, $P_{n,m}(2)$, of the pixel $P_{n,m}$.

15. The LCD of claim 13, wherein each of the first, second and third switching elements of the pixel $P_{n,m}$ of the pixel matrix $\{P_{n,m}\}$ is a field-effect thin film transistor having a gate, a source and a drain.

16. The LCD of claim 15, wherein the gate, the source and the drain of the first switching element of the pixel $P_{n,m}$ are electrically coupled to the gate line $G_{n+1}$, the source of the second switching element of the pixel $P_{n,m}$, and the first sub-pixel electrode of the pixel $P_{n,m}$, respectively; and wherein the gate, the source and the drain of the second switching element of the pixel $P_{n,m}$ are electrically coupled to the gate line $G_n$, the source of the first switching element of the pixel $P_{n,m}$, and the second sub-pixel electrode of the pixel $P_{n,m}$, respectively.

17. The LCD of claim 16, wherein the gate and the drain of the third switching element of the pixel $P_{n,m}$ are electrically coupled to the gate line $G_{n+2}$ and the sources of the first and second switching elements of the pixel $P_{n,m}$, respectively, while the source of the third transistor of the pixel $P_{n,m}$ is electrically coupled to the data line $D_m$ when n is an odd positive integer, or electrically coupled to the data line $D_{m+1}$ when n is an even positive integer.

18. The LCD of claim 13, further comprising:

(a) a gate driver for generating a plurality of gate signals respectively applied to the plurality of gate lines $\{G_n\}$, wherein the plurality of gate signals is configured to turn on the switching elements connected to the plurality of gate lines $\{G_n\}$ in a predefined sequence; and (b) a data driver for generating a plurality of data signals respectively applied to the plurality of data lines $\{D_m\}$, wherein the plurality of data signals is configured such that any two neighboring data signals have inverted polarities.

19. A method of driving a liquid crystal display (LCD), comprising the steps of:

(a) providing an LCD panel comprising:

(i) a plurality of pixels, $\{P_{n,m}\}$, spatially arranged in the form of a matrix, n =1, 2, . . N, and m =1, 2, . . M, and N, M being an integer greater than zero, each pixel $P_{n,m}$ comprising a first sub-pixel electrode, a second sub-pixel electrode, a first switching element electrically coupled to the first sub-pixel electrode, a second switching element electrically coupled to the second sub-pixel electrode, and a third switching element electrically coupled to the first and second switching elements;

(ii) a plurality of gate lines, $\{G_n\}$, spatially arranged along a row direction, wherein each pair of two neighboring gate lines $G_n$ and $G_{n+1}$ defines a pixel row $P_{n,\{m\}}$ of the pixel matrix $\{P_{n,m}\}$ therebetween and is electrically coupled to the first and second switching elements of each pixel $P_{n,m}$ in the pixel row $P_{n,\{m\}}$, respectively; and (iii) a plurality of data lines, $\{D_m\}$, spatially arranged crossing the plurality of gate lines $\{G_n\}$ along a column direction perpendicular to the row direction, wherein each pair of two neighboring data lines $D_m$ and $D_{m+1}$ defines a pixel column, $P_{\{n\},m}$, of the pixel matrix $\{P_{n,m}\}$ therebetween, and is electrically coupled to the third switching element of each pixel $P_{n,m}$ in the pixel column, $P_{\{n\},m}$; and (b) applying a plurality of gate signals to the plurality of gate lines $\{G_n\}$ and a plurality of data signals to the plurality of data lines $\{D_m\}$, respectively, wherein the plurality of gate signals is configured to turn on the switching elements connected to the plurality of gate lines $\{G_n\}$ in a predefined sequence, and the plurality of data signals is configured such that any two neighboring data signals have inverted polarities, wherein the gate, the source and the drain of the third switching element of the $P_{n,m}$ are electrically coupled to the gate line $G_{n+2}$, the data line $D_m$, and the sources of the first and second switching elements of the pixel $P_{n,m}$, respectively.

20. The method of claim 19, wherein each of the first, second and third switching elements of the pixel $P_{n,m}$ of the pixel matrix $\{P_{n,m}\}$ is a field-effect thin film transistor having a gate, a source and a drain.

21. The method of claim 20, wherein the gate, the source and the drain of the first switching element of the pixel $P_{n,m}$ are electrically coupled to the gate line $G_{n+1}$, the source of the second switching element of the pixel $P_{n,m}$, and the first sub-pixel electrode of the pixel $P_{n,m}$ , respectively; and wherein the gate, the source and the drain of the second switching element of the pixel $P_{n,m}$ are electrically coupled to the gate line $G_n$, the source of the first switching element of the pixel $P_{n,m}$, and the second sub-pixel electrode of the pixel $P_{n,m}$, respectively.

22. The method of claim 21, wherein the gate and the drain of the third switching element of the pixel $P_{n,m}$ are electrically coupled to the gate line $G_{n+2}$ and the sources of the first and second switching elements of the pixel $P_{n,m}$, respectively, while the source of the third transistor of the pixel $P_{n,m}$is electrically coupled to the data line $D_m$ when n is an odd positive integer, or electrically coupled to the data line $D_{m+1}$ when n is an even positive integer.

23. The method of claim 19, wherein each of the plurality of gate signals is configured to have a waveform, wherein the waveform has a first voltage potential $V_1$ in a first duration, $\Gamma_1$, a second voltage potential $V_2$ in a second duration, $\Gamma_2$, a third voltage potential $V_3$ in a third duration, $\Gamma_3$, a fourth voltage potential $V_4$ in a fourth duration, $\Gamma_4$, and a fifth voltage potential $V_5$ in a fifth duration, $\Gamma_5$, wherein the (j+1)-th duration $\Gamma_{j+1}$ is immediately after the j-th duration $\Gamma_j$, j =1, 2, 3 and 4, and wherein $V_1=V_3=V_5>V_2=V_4$, $\Gamma_2=\Gamma_1/2$, $\Gamma_3=(\Gamma_1-t)/2$, $\Gamma_4=t$, $\Gamma_5=\Gamma_3$, and $\Gamma_1>>t$.

24. The method of claim 23, wherein the waveform of each of the gate signals is sequentially shifted from one another by the duration of $\Gamma_1$.

* * * * *